US005188261A

United States Patent [19]

Butters

[11] Patent Number: 5,188,261

[45] Date of Patent: Feb. 23, 1993

[54] COLLAPSIBLE DRINK DISPENSER

[75] Inventor: Scott W. Butters, Bountiful, Utah

[73] Assignee: InoTec Corporation, Salt Lake City, Utah

[21] Appl. No.: 837,656

[22] Filed: Feb. 14, 1992

Related U.S. Application Data

[63] Continuation of Ser. No. 465,798, Jan. 12, 1990, abandoned.

[51] Int. Cl.[5] ..... B65D 35/08; B67D 5/60

[52] U.S. Cl. ..... 222/107; 222/105; 222/464

[58] Field of Search ..... 222/42, 105, 106, 107, 222/206, 211, 215, 464, 465.1; 215/229; 220/229; 383/66, 80; 229/103.1

[56] References Cited

U.S. PATENT DOCUMENTS

| | | | |
|---|---|---|---|
| 2,343,512 | 3/1944 | Lobl | 383/80 |
| 2,849,321 | 8/1958 | Lhermitte et al. | 99/171 |
| 3,383,017 | 5/1968 | Krings | 222/105 X |
| 3,604,491 | 12/1968 | Spiess | 150/8 |
| 3,638,834 | 2/1972 | Goodrich et al. | 222/105 |
| 3,799,914 | 3/1974 | Schmit et al. | 426/85 |
| 3,895,742 | 7/1975 | Wulbern | 222/105 |
| 4,257,535 | 3/1981 | Mellett | 222/92 |
| 4,378,069 | 3/1983 | Franco | 206/620 |
| 4,411,359 | 10/1983 | Franco | 206/217 |
| 4,553,693 | 11/1985 | Terajima et al. | 229/103.1 |
| 4,795,062 | 1/1989 | Bedwell et al. | 222/92 |
| 4,806,021 | 2/1989 | Koudstaal et al. | 383/40 |

*Primary Examiner*—Kevin P. Shaver

*Attorney, Agent, or Firm*—Workman Nydegger & Jensen

[57] ABSTRACT

The present invention is directed to collapsible dispensing containers for beverages and other products. The body of the containers is capable of being completely collapsed in a horizontal plane. The body of the container comprises two flat, parallel, and flexible body members sealed or otherwise positioned together to form a flat, envelope-like pouch. One body member incorporates an access port for introducing product into and withdrawing product from the dispensing container. The configuration access port prevents spills or leaks by narrowly circumscribing access to the product held in the dispensing container.

34 Claims, 5 Drawing Sheets

COLLAPSIBLE DRINK DISPENSER

This application is a continuation of U.S. application Ser. No. 07/465,798, filed Jan. 12, 1990, for COLLAPSIBLE DRINK DISPENSER, now abandoned.

BACKGROUND

1. The Field of the Invention

The present invention relates to devices for beverage containment and drink dispensing. More particularly, the present invention is directed to drink dispensing devices having containment bodies which collapse completely flat in a horizontal plane like an envelope and having a spout configuration which prevents spilling or leaking.

2. Description of the Currently Available Products

Many different containers have been devised for the convenient, inexpensive, or disposable dispensing of beverages and other packaged products. As a result, the devices currently available represent a variety of containers such cups, cans, bottles, boxes, and other containers made of a variety of materials such as tin, aluminum, rigid plastic, styrofoam, glass, paper, cardboard, flexible materials, and other materials. For purposes of this application, discussion of currently available dispensing containers is directed to containers constructed substantially of flexible material, exclusive of traditional tin, aluminum, rigid plastic, styrofoam, glass, cardboard, and the like. Similarly, the following discussion is directed to containers other than traditional cups, cans, bottles, boxes, and the like.

Many currently available dispensing containers are constructed of flexible material, such as a thermoplastic like polyethylene, and which containers are to some degree collapsible when empty. Such containers have, when full, substantially rigid, yet flexible, wall members. In order for some currently available containers to be of practical use, the base of the containers must be adapted or modified in such a manner to provide a flat surface in order to support or maintain the container in an upright position in its normal standing position. Some devices require folding the wall or base members in order to provide the necessary flat resting surface. Other devices use a series of cuts, shapes, and welds of wall or base members to provide a flat or effectively flat resting surface to maintain the container in an upright position in its normal use. The currently available devices must rest in an upright position in order to avoid leaking or spilling of the contained beverages once the product has been accessed for dispensing.

Other currently available containers require the dispenser to be supported by some independent structure or support system in order for practical use of the device to be effective. For example, some embodiments must be held in one's hand at all times. Others, if the side walls are sufficiently rigid, must lean against an object to prevent spilling or leakage. Still others must actually hang or be otherwise supported on or about the upper portion in order to be maintained in an upright manner.

The vast majority of such flexible, somewhat collapsible containers require the contained product to be inserted, injected, or filled before the construction of the containers is completed. For example, currently available devices leave a portion of the container unsealed during the manufacturing process until such time as the intended product has been placed in the container. As a result, the complete manufacturing of the container must be incorporated into the packaging of the product, or vice-versa. This is not only costly but also limits the use of the container to the designated product only.

Similarly, nearly all of the currently available flexible containers are designed to be disposable after one use. This is a result of not only the economics of manufacture, but is also of necessity whereas the structural integrity of the devices' containment members is compromised in one manner or another to gain access to the contained product, i.e., either by puncturing a wall member, tearing or cutting away a portion of the container, or by otherwise causing a slit or tear to at least one member of the containment system.

The currently available containers suffer operational inefficiency by the absolute requisite that the container remain in a very limited range of upright positions. This is a result of the structural requirement of resting on a secure, flat surface. Most devices have just one position, the upright position, in which the device contains the product without spills or leaks. In other words, the containment integrity of the currently available devices depends upon the secure or constant nature of the surface or structure which is supporting the dispensing device. If the devices tip from their upright position even partially, they may spill or leak.

Furthermore, the currently available dispensing devices require a relatively significant amount of space in which to store the device when empty. In other words, the ratio of the volume of potential holding capacity of the container to the volume of space needed to store the empty container is quite low. As a result, the currently available devices cannot efficiently be stored in large quantities for ready or immediate use.

BRIEF SUMMARY AND OBJECTS OF THE INVENTION

The present invention is directed to collapsible dispensing containers. More particularly, the present invention is directed to dispensing containers having a container body which, when empty, lies entirely collapsed in a horizontal plane and which has an access member which prevents conventional spill and leak occurrences.

The present invention is directed to a container with a container body and an access member. The body of the container comprises two members of flexible material. A first body member may function as the upper or first portion of the container. A second body member may function as the lower or second portion of the container. The first body member having an aperture to, on, or about which the access member is attached. The body members are positioned relative to each other in parallel plane configuration by welding or otherwise sealing the perimeter edges of the body members together to form one body. This results in a biasing of the first body member toward the second body members, and vice-versa. Such a construction results in the circumferential biasing of the first body member toward the second body member. The present invention also contemplates a container body comprising first and second body members being a one-piece, unitized construction not by welding or sealing the two body members together, but by forming, folding or otherwise shaping the container body so long as the first and second body members bias toward each other. As a result, when the container is empty, the container body comprising the first and second body members lies entirely flat in a horizontal plane like an envelope.

The access member readily permits product to be both placed into and/or drawn out from the container through an orifice, as the user desires, without compromising the integrity of the body of the container or significantly compromising the integrity of the structure of the access member. The orifice of the access member is designed to receive a straw, other withdrawing mechanisms, and the like. The access member also functions to prevent spills and leak. It will also be appreciated that the effect of gravity upon the access member also biases the first and second body members of the container body toward each other.

It is an object of the present invention to provide a collapsible dispensing container which does not require an adapted or modified base or wall configuration in order to provide an effective base for supporting the container in an upright position.

Another object of the present invention is to provide a collapsible dispensing container which does not require the assistance of an independent structure or article to secure the upright position of the container.

Yet another object of the present invention is to provide a collapsible dispensing container whose principal container body members bias toward each other, and, when the container is empty, the body members lie flat against each other in a horizontal plane.

A further object of the present invention is to provide a collapsible dispensing container whose containment body may be completely sealed or welded prior to the introduction of any product into the container such that the manufacture of the container may be geographically remote from the actual introduction of product into the container.

Still another object of the present invention is to provide a collapsible dispensing container which is cost effectively manufactured to permit disposable use but which, if desired, may be reused.

Yet another object of the present invention is to provide a collapsible dispensing container which does not require a substantially horizontal or planar support surface to assure that the container maintain an upright position.

An additional object of the present invention is to provide a collapsible dispensing container which may be stored in a volume of space substantially less than the potential volume capacity of the container.

DETAILED DESCRIPTION OF THE PREFERRED EMBODIMENTS

The present invention is directed to collapsible dispensing containers, especially for beverages. More particularly, the present invention comprises a flexible container pouch which lies flat when empty. The configuration of the container results in maintaining a substantially flat lower support surface at all times and such that special manufacturing, folds, adaptations, or modification to the container walls are unnecessary for structural support.

The dispensing containers contemplated by the present invention comprise a container pouch or body, and an access member. The container body, when empty, lies entirely flat with the access member directed upwardly. When product is introduced into the container body, the container body expands relative to the volume of liquid introduced.

The access member permits introduction of product into the container body and also permits withdrawal of product from the container body while preventing spilling and leaking of the product.

Figure 1:
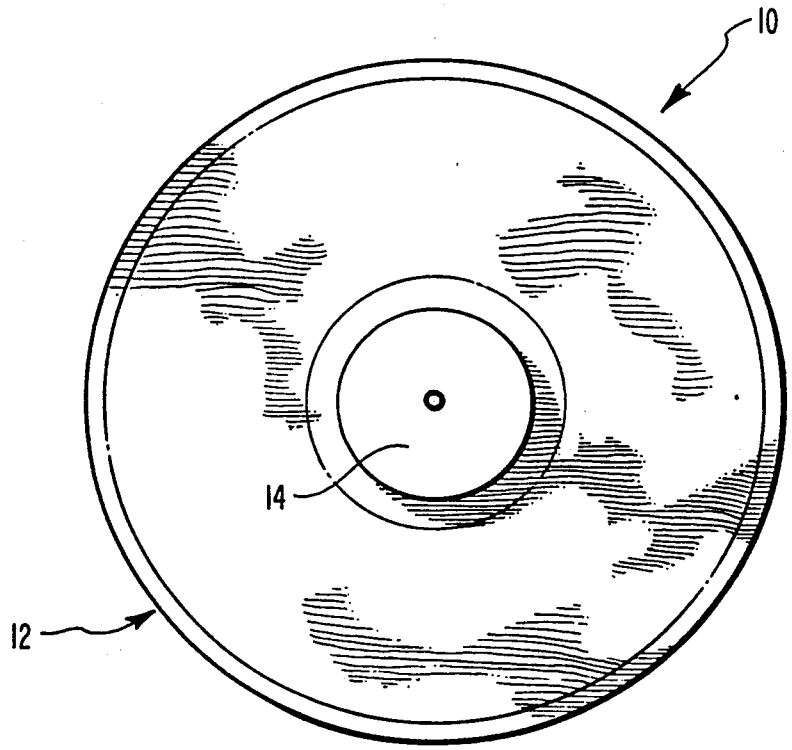
FIG. 1 shows a plan view of one embodiment of the dispensing container of the present invention.
Figure 2:
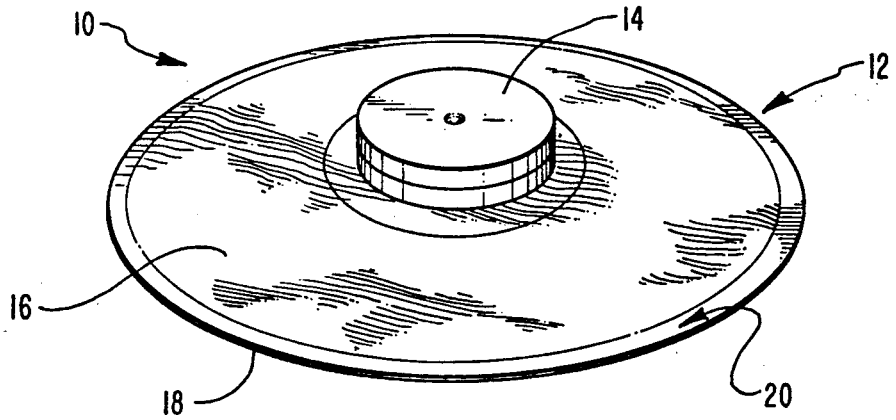
FIG. 2 is a perspective view of one embodiment of the dispensing container of the present invention.

The dispensing container 10 is shown in plan view in FIG. 1. The preferred dispensing container 10 comprises a substantially circular container body 12 and an access member 14. FIG. 2 illustrates the dispensing container shown in FIG. 1 in a perspective view. Container body 12 comprises a first body member or sheath 16 of flexible material, and a second body member or sheath 18 of flexible material. The first body member 16 and second body member 18 are of substantially the same shape and same area, i.e., equidimensional. The preferred embodiment as shown in FIGS. 1 through 3 contemplate first body member 16 and second body member 18 as being coextensive.

While the illustrated preferred embodiment is generally circular in design and construction, such a configuration is not requisite to the invention. For example, a container within the scope of this invention could have a plan view substantially square, rectangular, oval, heart-shaped, or triangular, or any number of other shapes. Similarly, the three dimensional shape or a flexible, collapsible container within the scope of this invention could correlate with a sporting event and be shaped like a basketball, football, baseball, and the like. Similarly, the shape of the container could be constructed to be consistent with historical, period, and seasonal themes and celebrations such as a wreath, a pumpkin, a heart, and the like.

Figure 3:
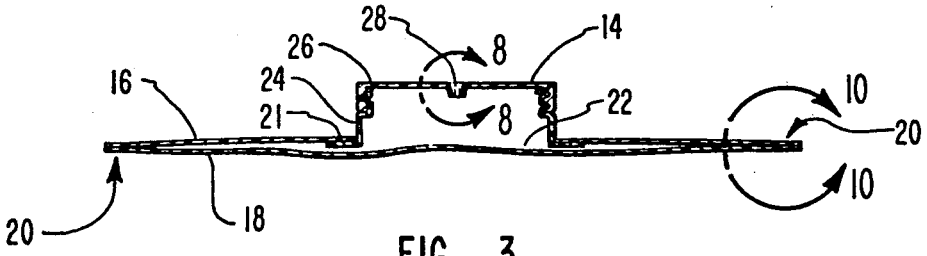
FIG. 3 is a cross-section of the dispensing container shown in FIG. 2.

As shown in FIGS. 1-3, first body member 16 is circumferentially welded or otherwise sealed to second body member 18 at or near the perimeter of first body member 16 and second body member 18 as represented by perimeter seal 20. Because first body member 16 and second body member 18 are sealed together in such a manner, first body member 16 and second body member 18 bias toward each other. As a result, when empty, the container body 12 lies entirely collapsed as shown in FIG. 3 because first body member 16 is positioned flat against second body member. The repose position of the empty container as shown in FIG. 3 is identified as the collapsed or envelope state. The preferred embodiment contemplates that first body member 16 and second body member 18 comprise polyethylene terephthalates. Suitable container within the scope of this invention could also be constructed of any food grade material, such as those approved by the Food and Drug Administration (FDA).

The present invention also contemplates a unitized configuration of container body 12, not shown. That is, is it possible to provide first body member 16 and second body member 18 biased toward each other constructed in a one-piece construction. This would be possible by molding container body 12 in the configuration generally illustrated in FIGS. 1-3, or by folding or gathering container body 12 in such a manner to provide a similar configuration. Further, the present invention also contemplates a similar result being obtained by structuring the container body 12 by merely gathering the edges of one sheath to form a pouch and forming a rigid ring from the sheath material itself to operate in injunction with or as the access member 14, or by gathering and sealing one sheath about access member 14.

First body member 16 has an aperture 22 which is filled by attaching access member 14 to aperture 22. Access member 14 is the means through which product is introduced into the dispensing container 10 and through which product is withdrawn from the dispensing container 10. Access member 14 may have dimensions to receive container body 12, see FIGS. 3,5, and 9, or may have very small axial or annular dimensions such as, for example, a ring of material more rigid than container body 12.

Figure 4:
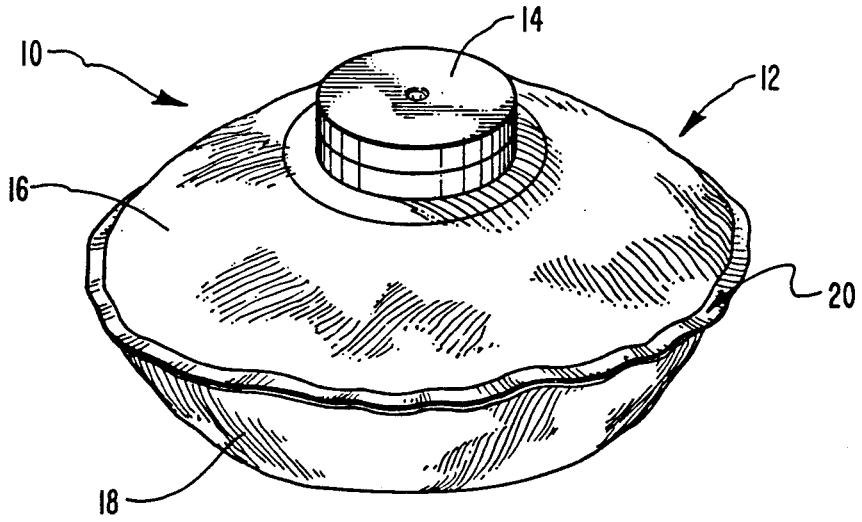
FIG. 4 is a perspective view of one embodiment of the dispensing container of the present invention containing product.
Figure 5:
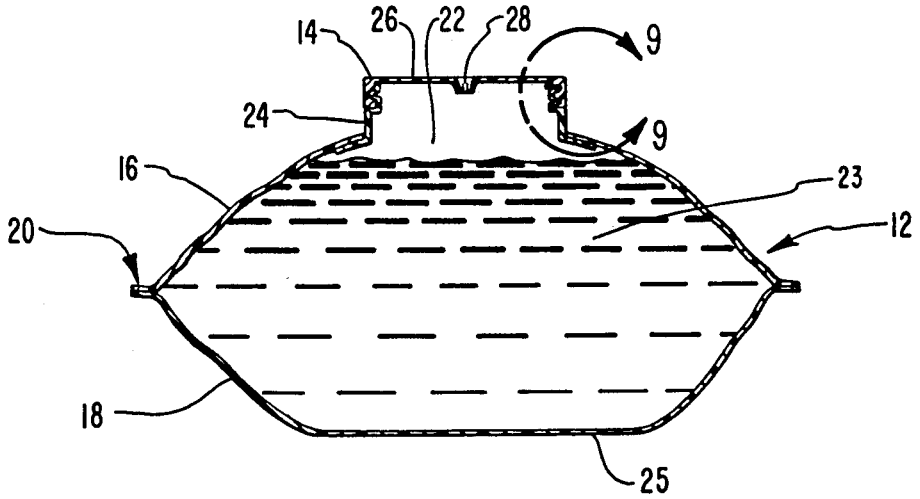
FIG. 5 is a cross-section of the dispensing container shown in FIG. 4.

FIG. 4 represents a perspective view of dispensing container 10 after product has been introduced into dispensing container 10. FIG. 5 is a cross-section of the embodiment shown in FIG. 4. FIG. 5 shows the adaptable nature of first body member 16 and second body member 18 to accommodate product 23. At all times, the second body member 18 has a base portion 25 which substantially conforms to the surface on which dispensing container 10 rests. In the preferred embodiment, base portion 25 remains large relative to the overall height of dispensing container 10. As a result, the dispensing container has a low center of gravity and rests securely on the underlying surface and inhibits tipping the dispensing container 10 over.

Figure 6:
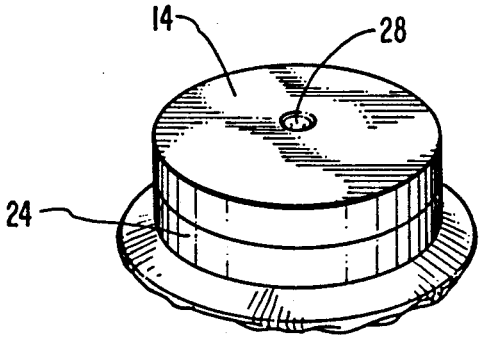
FIG. 6 is a perspective view of the container body stored within the access member of the dispensing container of the present invention.
Figure 7:
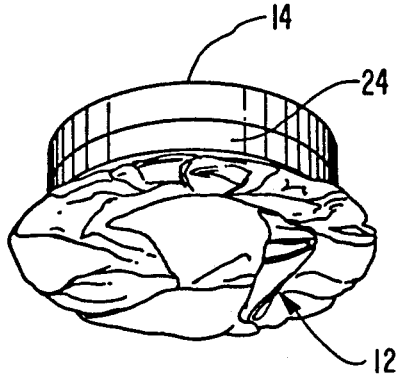
FIG. 7 is another perspective of the container body stored within the access member of the dispensing container of the present invention.

FIGS. 6 and 7 illustrate, for example, that the entire container body 12 may be stored or packed for shipping or for convenience of disbursing, if desired, within the interior of access port 14. As a result, the device may be packaged and readied for use in an economical fashion without the need of dedicating large quantities of space for the storage or disbursement of dispensing container 10.

Figure 9:
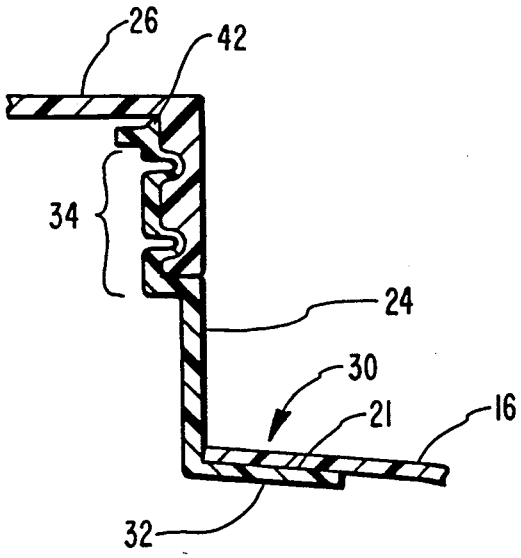
FIG. 9 is an exploded view of the cross-section of the integral seal of the access member.

FIGS. 3 and 5 show one preferred embodiment of access member 14. Access member 14 comprises a base portion 24 and a cap portion 26. As shown in FIG. 9, base portion 24 has means 34 for joining base portion 24 to cap portion 26, and a flange or end 32. Base portion 24 is sealed by circumferential seal 21 to first body member 16 by overlap 30 of first body member 16 and flange 32 of base portion 24. Base portion 24 further comprises a sealing rim 42 which seats against cap portion 26 to form a circumferential seal at the juncture of base portion 24 and cap portion 26.

Cap portion 26 is sealably, yet detachably positioned about base portion 24. The sealable, yet detachable interfacing of cap portion 26 and base portion 24 may be accomplished in any number of conventional manners. FIG. 9 illustrates the use of threaded cap portion 26 and base portion 24. Detaching cap portion 26 provides access into the interior of container body 12 through aperture 22 for the convenient introduction of product into dispensing container 10.

The configuration of access member 14 is not limited to the illustrations above. For example, the present invention also contemplates access member 14 being a part of or formed from first body member 16. In this manner, access member 14 would be integral to first body member 16 and be a means for providing a passageway through first body member 16 for accessing the contained product.

Figure 13:
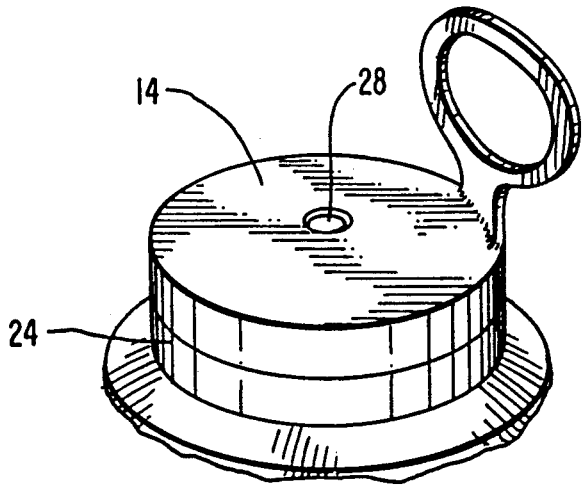
FIG. 13 illustrates a mechanism for carrying devices embodying the present invention.

It should also be recognized that base portion 24 or cap portion 26 may have additional structures which aid in the practical use of the container within the scope of this invention. For example, a loop, ridge, hook, or equivalent structure added to base portion 24 or cap portion 26 could serve to aid in carrying or otherwise transporting a container, whether empty or full, FIG. 13. Similarly, a cork, stop, plug, straw cap, or the like could be removably attached to base portion 24 or cap portion 26 for added convenience when a withdrawal mechanism such as a straw is withdrawn from the container or the user desires to cap the straw. As a result, even in the absence of a straw, the flexible, collapsible container could maintain the superior ability to prevent leak and spills.

Figure 8A:
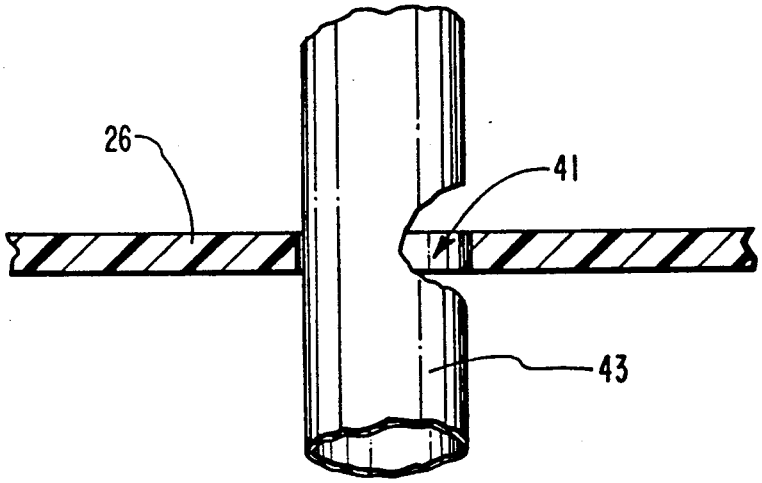
FIG. 8*a* is an exploded view of the cross-section of a portion of the access member showing the orifice portion designed to be sufficiently compatible with standard size straws.

The configuration of the orifice for the straw or other withdrawal mechanism also serves to enhance the ability of the collapsible container of the present invention to prevent leaks and spills. As shown in FIG. 8*a*, the orifice or opening 41 in cap portion 26 which serves to provide access to the contained product compatibly receives straw or withdrawal mechanism 43 without fixing the relative position of straw 43 to orifice 41. As a result, as container body 12 adapts to its support environs and/or the amount of product in the container, access member 14 may rise or fall around withdrawal mechanism 43. On the other hand, orifice 41 may not be so large relative to withdrawal mechanism 43 such that the seal or containment effect of the overall structure is compromised.

Figure 8B:
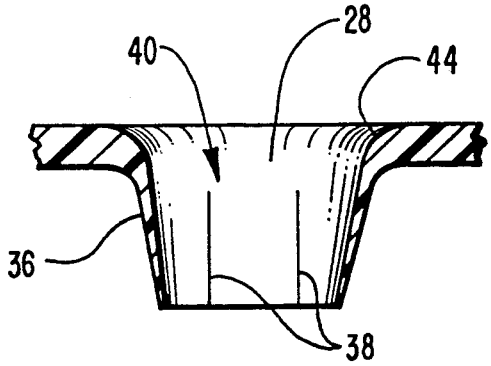
FIG. 8*b* is an exploded view of the cross-section of a portion of another embodiment of the access member having a withdrawal orifice adaptable to a range of sizes of straws as shown in FIG. 3.

Another embodiment of a cap portion 26 is shown in FIGS. 3 and 5. This embodiment is designed to accommodate withdrawal mechanism sizes which vary significantly. Cap portion 26 comprises orifice 28 for access to the interior of container body 12 when cap portion 26 is joined to base portion 24. As shown in FIG. 8*b*, orifice 28 is substantially circular and comprises a sidewall 36 extending away from cap portion 26 surrounding orifice 28 in such a manner that sidewall 36 converges toward the center of orifice opening 40 forming a tapered opening. Sidewall 36 also has evenly spaced slits 38. Orifice 28 is suited to receive varying sizes of straws or other similarly functional mechanisms employed to withdraw product from the interior of container body 12. The tapered nature of the orifice opening 40 provides ease of placing a withdrawal mechanism in orifice 28, while also functioning to adequately seal around the inserted withdrawal device at a point distal to the tapered shoulder 44. Slits 38 permit sidewall 36 to expand to terminate the taper, if necessary, so as to be circumferentially compatible with the given size of the chosen withdrawal mechanism device.

Figure 12:
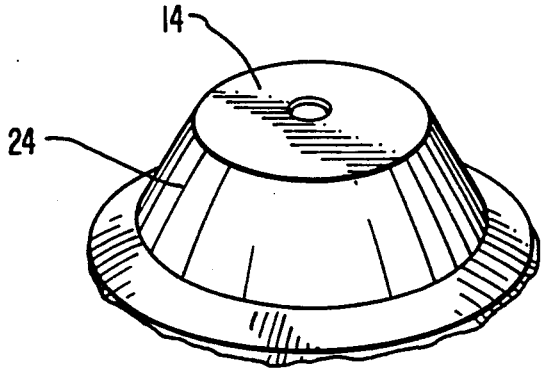
FIG. 12 illustrates an alternative frustoconical embodiment of the access port.

While the access member 14 is represented as generally cylindrical in configuration, the present invention also contemplates a conical frustum or disc configuration, not shown, for ease of stacking, storing, or packaging the dispensing container of the present invention without storing the container body 12 within the interior of the access member 14, FIG. 12. A flat or arcuate disc configuration would contemplate any disc cap seated in, on, or about, a flat or arcuate base portion. It is also possible to configure access member 14 such that its operation is not a function of or does not rely upon access member 14 protruding significantly above aperture 22. Furthermore, the appearance of access member 14 may be configured to be in many shapes such as basketball, footballs, baseballs, and the like.

Similarly, while the access member 14 is represented as a cap portion 26 being joined to base portion 24 by way of conventional threads, any suitable means for joining cap portion 26 to base portion 24 is contemplated. For example, a press-seal, hinged, snap-on, or slid-on configuration, and the like, not shown, may also be suitable.

Figure 10:
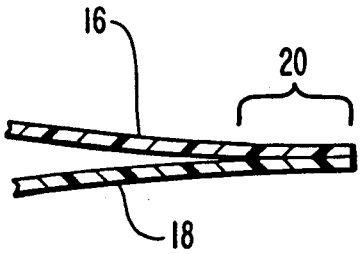
FIG. 10 is an exploded view of the cross-section of the seal or weld zone at or near the perimeter of the sheaths of flexible material comprising the container body as shown in FIG. 3.
Figure 11:
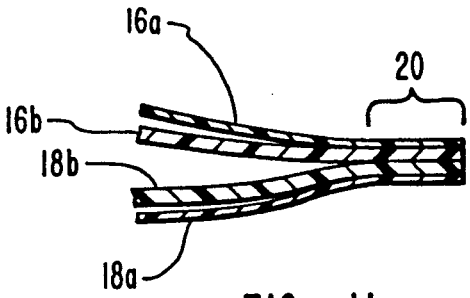
FIG. 11 illustrates an alternative seal or weld zone as shown in FIG. 10 if the wall of the container body comprises multiple sheaths or layers of flexible material.

FIG. 10 shows a detail of the weld or seal zone 20 about the perimeter of first body member 16 and second body member 18. In the event that the integrity of container body 12 required multiple layers **16*a* and 16*b* of materials to form the first body member and/or multiple layers 18*a* and 18*b* to form the second body member of container body 12, FIG. 11 shows a similar weld or seal zone 20 to accommodate layered sheath walls. And while welding or sealing first body member 16 to second body member 18 is preferred at this time, the present invention also recognizes the possibility of molding, folding, or otherwise fashioning a one-piece sheath member to form first body member 16 and second body member 18** such that they bias toward each other.

The present invention is directed to flexible, collapsible containers or dispensing device without limitation as to the nature of the product so contained or dispensed. Similarly, the physical characteristics of the subject product is not controlling as to the effectiveness of the present invention. For example, the technology of collapsible beverage containers of this invention is equally applicable to applications directed to containing hot or cold beverages by employing the same or similar construction materials.

The present invention may be embodied in other specific forms without departing from its spirit or essential characteristics. The described embodiments are to be considered in all respects only as illustrative and not restrictive. The scope of the invention, is, therefore, indicated by the appended claims rather than by the foregoing description. All changes which come within the meaning and range of equivalency of the claims are to be embraced within their scope.

What is claimed is:

1. A collapsible beverage container comprising:

a container pouch body comprising:

a substantially flat first body member lying in a horizontal plane, the first body member having an aperture; and a substantially flat second body member lying in a parallel horizontal plane sealed to the first body member at or near the perimeter of the body members such that when empty the container pouch lies flatly collapsed upon itself in a horizontal plane; and an access member defining an opening therein permitting continual passage of air in or out of the container such that the access member may rise and fall during use, the access member being sealed about the aperture of the first body member and extending upwardly during use from the first body member.

2. A collapsible beverage container as defined in claim 1 wherein the access member comprises a base portion and a cap portion.

3. A collapsible beverage container as defined in claim 2 wherein the base portion comprises:

a sidewall;

a flange extending away from the sidewall to which the first body member of the container body is sealably affixed;

means for detachably joining the cap portion; and a surface to sealably seat against the cap portion, and wherein the cap portion comprises:

means for detachably joining the base portion;

means for receiving the sealing surface of the base portion to form a hermetic seal; and wherein the opening is an orifice accessing the interior of the dispensing container.

4. A collapsible beverage container as defined in claim 3 wherein the orifice comprises:

a sidewall extending away from the cap portion surrounding the orifice, the sidewall converting inward to form a tapered orifice opening; and slits in the length of the side walls distal from the cap portion surrounding the orifice whereby lateral forces caused by the insertion of a withdrawal mechanism into the orifice may terminate the taper of the side walls.

5. A collapsible beverage container as defined in claim 1 wherein the first body member and the second body member are comprised of any FDA food grade material.

6. A collapsible beverage container as defined in claim 1 wherein the first body member and the second body member are comprised of polyethylene terephthalates.

7. A collapsible beverage container as defined in claim 1 wherein the first body member and the second body member are generally circular in shape.

8. A collapsible beverage container as defined in claim 7 wherein the generally circular body members are equidimensional.

9. A collapsible beverage container as defined in claim 1 wherein the first body member and the second body member are generally elliptical in shape.

10. A collapsible beverage container as defined in claim 9 wherein the generally elliptical body members are equidimensional.

11. A collapsible beverage container as defined in claim 1 wherein the access member is generally cylindrical in shape.

12. A collapsible beverage container as defined in claim 1 wherein the access member is generally frustoconical in shape.

13. A collapsible beverage container as defined in claim 1 wherein the access member is generally disc shaped.

14. A collapsible beverage container as defined in claim 1 further comprising a loop to aid in carrying the container.

15. A collapsible beverage container comprising:

a container pouch body comprising:

a substantially flat first body member lying in a horizontal plane, the first body member having an aperture; and a substantially flat second body member lying in a parallel horizontal plane sealed to the first body member at or near the perimeter of the body members such that when empty the container pouch lies flatly collapsed upon itself in a horizontal plane; and an access member defining an opening therein permitting continual passage of air in or out of the container such that the access member may rise or fall during use, the access member sealed about the aperture of the first body member, and extending upwardly during use from the first body member wherein the access member further comprises a base portion and a cap portion, the base portion comprising: a sidewall;

a flange extending away from the sidewall to which the first body member of the container body is sealably affixed;

means for detachably joining the cap portion;

a surface to sealably seat against the cap portion; and wherein the cap portion comprises:

means for detachably joining the base portion;

means for receiving the sealing surface of the base portion to form a seal; and wherein the opening is an orifice accessing the interior of the dispensing container.

16. A collapsible beverage container as defined in claim 15 wherein the first body member and the second body member are comprised of any FDA food grade material.

17. A collapsible beverage container as defined in claim 16 wherein the first body member and the second body member are comprised of polyethylene terephthalates.

18. A collapsible beverage container as defined in claim 15 wherein the first body member and the second body member are generally circular in shape.

19. A collapsible beverage container as defined in claim 18 wherein the generally cylindrical body member are equidimensional.

20. A collapsible beverage container as defined in claim 15 wherein the first body member and the second body member are generally elliptical in shape.

21. A collapsible beverage container as defined in claim 20 wherein the generally elliptical body members are equidimensional.

22. A collapsible beverage container as defined in claim 15 wherein the access member is generally cylindrical in shape.

23. A collapsible beverage container as defined in claim 15 wherein the access member is generally frustoconical in shape.

24. A collapsible beverage container as defined in claim 15 wherein the access member is generally disc shaped.

25. A collapsible beverage container as defined in claim 15 wherein the orifice comprises:

sidewalls extending away from the cap portion surrounding the orifice, the sidewalls converging inward to form a tapered orifice opening; and slits in the length of the tapered side walls distal from the cap portion surrounding the orifice whereby lateral forces caused by the insertion of a withdrawal mechanism into the orifice may terminate the taper of the sidewalls.

26. A collapsible beverage container comprising:

a container pouch comprising a substantially flat first body member in a horizontal plane biased toward a substantially flat second body member in a horizontal plane, the first body member having an aperture therein, and an access member defining an opening therein permitting continual passage of air in or out of the container such that the access member may rise or fall during use, the access member closing the aperture of the first body member and extending upwardly during use from the first body member.

27. A collapsible beverage container as defined in claim 26 wherein the access member is affixed to the first body member.

28. A collapsible beverage container as defined in claim 26 wherein the access member is integral to the first body member.

29. A collapsible beverage container comprising:

a container pouch comprising a substantially flat first body member in a horizontal plane sealed to a substantially flat second body member in a horizontal plane, the first body member having an aperture therein, and an access member defining an opening therein permitting continual passage of air in or out of the container such that the access member may rise or fall during use, the access member closing the aperture of the first body member and extending upwardly during use from the first body member.

30. A collapsible beverage container as defined in claim 29 wherein the access member is affixed to the first body member.

31. A collapsible beverage container as defined in claim 29 wherein the access member integral to the first body member.

32. A collapsible beverage container comprising:

a container pouch comprising a first body member in a horizontal plane biased against a second body member in a horizontal plane, the first body member having an aperture, and an access member defining an opening therein permitting continual passage of air in or out of the container such that the access member may rise or fall during use, the access member sealed about the aperture of the first body member and extending upwardly during use from the first body member.

33. A collapsible beverage container comprising:

a container pouch body comprising:

a substantially flat first body member lying in a horizontal plane, the first body member having an aperture; and a substantially flat second body member lying in a parallel horizontal plane sealed to the first body member at or near the perimeter of the body members, and an access member sealed about the aperture of the first body member extending upwardly during use from the first body member, the access member defining an opening therein permitting continual passage of air in or out of the container such that the access member may rise or fall during use, and such that when product is introduced into the container at least a portion of the opening permitting continual passage of air in or out of the container remains disposed above the level of the product in the container.

34. A collapsible beverage container comprising:

a container pouch body comprising:

a substantially flat first body member lying in a horizontal plane, the first body member having an aperture; and a substantially flat second body member lying in a parallel horizontal plane sealed to the first body member at or near the perimeter of the body members, and an access member defining an opening therein permitting continual passage of air in or out of the container such that the access member may rise or fall during use, the access member sealed about the aperture of the first body member and extending upwardly during use from the first body member, such that when product is introduced into the container the first body member is displaced from the second body member and when product is withdrawn from the container the displacement of the body members decreases.

* * * * *

UNITED STATES PATENT AND TRADEMARK OFFICE

CERTIFICATE OF CORRECTION

PATENT NO. : 5,188,261

DATED : February 23, 1993

INVENTOR(S) : SCOTT W. BUTTERS

It is certified that error appears in the above-identified patent and that said Letters Patent is hereby corrected as shown below:

Column 2, line 1, "having" should be --has--
Column 3, line 9, "leak" should be --leaks--
Column 3, line 11, delete "also"
Column 5, line 18, "container" should be --containers--
Column 5, line 24, "is it" should be --it is--
Column 5, line 63, "disbursing" should be --dispersing--
Column 5, line 67, "disbursement" should be --dispersement--
Column 6, line 43, "leak" should be --leaks--
Column 7, line 50, "device" should be --devices--
Column 9, line 29, "a sidewall;" should be on a new line
Column 10, lines 48-49, delete "wherein the access member integral to the first body member." and insert therefor --wherein the access member is a part or formed from the first body member.--
Column 9, lines 55-56, "member" should be --members--

Signed and Sealed this

Eighth Day of March, 1994

*Attest:*

Bruce Lehman

BRUCE LEHMAN

*Attesting Officer*

*Commissioner of Patents and Trademarks*